United States Patent [19]

Hasegawa et al.

[11] 4,091,727

[45] May 30, 1978

[54] HEAT-SENSITIVE COPYING METHOD FOR PREPARATION OF PRINTING STENCILS

[75] Inventors: Takanori Hasegawa; Yoshio Tsuji, both of Tokyo, Japan

[73] Assignees: Asahi Dow Limited; Riso Kagaku Corporation, both of Tokyo, Japan

[21] Appl. No.: 593,185

[22] Filed: Jul. 7, 1975

Related U.S. Application Data

[63] Continuation of Ser. No. 385,246, Aug. 3, 1973, abandoned.

[51] Int. Cl.[2] ..... B41N 1/24; B41C 1/14

[52] U.S. Cl. ..... 101/128.2; 101/128.4; 156/229; 250/317

[58] Field of Search ..... 101/128.2, 128.4; 156/229; 250/317–319, 327

[56] References Cited

U.S. PATENT DOCUMENTS

| | | | |
|---|---|---|---|
| 2,844,733 | 7/1958 | Miller et al. | 117/36.8 X |
| 2,868,124 | 1/1959 | Crawford | 250/327 X |
| 3,103,881 | 9/1963 | Grieshaber | 250/318 X |
| 3,163,755 | 12/1964 | Kotz et al. | 250/319 |
| 3,619,157 | 11/1971 | Brinckman | 101/456 |

FOREIGN PATENT DOCUMENTS

| | | | |
|---|---|---|---|
| 696,563 | 9/1953 | United Kingdom | 101/128.4 |
| 707,160 | 4/1954 | United Kingdom | 101/128.4 |
| 647,059 | 12/1950 | United Kingdom | 156/229 |

*Primary Examiner*—Clyde I. Coughenour
*Attorney, Agent, or Firm*—Flynn & Frishauf

[57] ABSTRACT

A stencil sheet having a thin stretched thermoplastic resin film supported on an ink pervious porous substrate is positioned on an original manuscript in a manner such that the film may be in close contact with the imaged side of the manuscript. The assembly is then irradiated by a light which is rich in rays having a wavelength ranging from 0.7 to 1.2 microns and has a flash duration of from $10^{-4}$ to $10^{-3}$ second. A xenon-filled electronic flash discharge tube is found to be the most suitable light source. Stencil openings formed thereby on the film surface are excellent in definition and free from marginal swelling therearound. The stencil prepared by this method can produce copies of 2000 or more which correspond exactly with the original manuscript.

8 Claims, 17 Drawing Figures

HEAT-SENSITIVE COPYING METHOD FOR PREPARATION OF PRINTING STENCILS

This is a continuation, of application Ser. No. 385,246, filed Aug. 3, 1973, now abandoned.

This invention relates to an improved method for preparing a printing stencil. More particularly, this invention relates to an improved heat-sensitive copying method for producing a printing stencil, which comprises using a stretched thermoplastic resin film supported on an ink pervious porous substrate as a stencil sheet.

Preparation of a printing stencil by heat-sensitive copying method has heretofore been practiced by using a stencil sheet having a thin stretched thermoplastic film supported on an ink pervious base substrate. Said thermoplastic film is about 5 to 12 microns thick and made usually from such thermoplastic polymers as vinylidene chloride-vinyl chloride copolymer, polypropylene and the like. Materials for base substrates may include chemical fibers such as, regenerated cellulose, polyvinyl alcohol fiber (e.g., Vinylon), polyester fiber (e.g. polyethylene terephthalate), polyamide fiber (e.g., nylon) and the like as well as natural fibers such as paper mulberry, mitsumata (Edgeworthia chrysantha), Manila hemp, and the like. They are formed into thin paper sheets having a weight per unit area in the range from about 8 to about 12 g/m$^2$ to provide for base substrates. Stencil opening by the use of this stencil sheet is usually conducted by positioning the thermoplastic film of the stencil sheet in close contact with an original manuscript wherein letters, figures, patterns, etc., are written in printing inks containing light-absorptive substances such as carbon, and then directing radiations rich in infra-red upon the stencil sheet by means of a heat-sensitive copying machine embodying a tungsten incandescent lamp with a color temperature of 2500° to 3000° K (for example, "Thermofax" produced by 3M Co.), whereby stencil openings corresponding with the image portions of the original manuscript are formed on the thermoplastic film by the heat generated on said image portions by absorption of infra-red radiations.

The thermoplastic film used in the stencil sheet as described above is generally produced by inflation molding or biaxial stretching method. A considerably large extent of stretching is usually effected during the production procedures by such methods. Accordingly, if this film is directly provided for uses without any post-treatment, excessively large openings are caused by the high degree heat-shrinkage of the film on infra-red radiations. The openings thereby formed are very poor in resolution. In other words, excessively bold images are formed which, in subsequent printing, can produce only too indistinct printed images. Furthermore, due to the marginal swelling (which look like craters on the surface of the moon) or other deformations around the openings caused by the fusion of the film at portions corresponding with the images on the original manuscript at the time of irradiation by tungsten incandescent lamp, interior as well as exterior curvatures are formed on the film surface to impair the flatness of said film. Consequently, closeness of contact of the film with the original manuscript is also impaired. The film is then detached from heat at some portions, whereby no opening distinct in minute detail of the original manuscript can be obtained.

In order to alleviate such drawbacks as mentioned above of the highly stretched film of a thermoplastic synthetic resin, for example, vinylidene chloride-vinyl chloride copolymer which is most suitable as a film for stencil sheet, heat treatment is applied to the film prior to fixing on a support. The degree of heat-shrinkage of the film is adjusted so as to prevent the film from excessively large openings by infra-red radiations. The stencil sheet thus prepared may practically be used, but the stencil produced therefrom cannot in some cases be free from excessively bold images. In addition to the preventive step as mentioned above, further approaches are made for prevention of excessive boldness of the opened images. That is, exposure is controlled by trials and errors by accelerating the movement speed of the assembly of the stencil sheet positioned on the original manuscript. However, openings formed by this method may sometimes become thin. Therefore, skill as well as time are needed for production of complete duplicates by this method.

According to another heat-sensitive copying method, a relatively thick unsupported plastic film (suitable thickness from 0.1 to 3.0 mils) is used as a stencil sheet, as disclosed in U.S. Pat. No. 2,699,113. Said patent also discloses that radiant energy capable of the phenomenon of heat generation upon absorption in the materials comprising the dark areas on the copy may be derived from light sources rich in infra-red, which includes rays having a wave length ranging from 8,000 to 40,000 angstroms. A photographer's flash lamp is particularly mentioned as a suitable light source. Such a light source, however, cannot practically be used because of the following reasons. First of all, a flash lamp of a considerably large scale is required for irradiation upon a stencil sheet having a usual size. In addition, for accomplishment of uniform irradiation, plural flash lamps must be flashed at the same time. Furthermore, as a flash lamp cannot be used repeatedly, it must be replaced with another new bulb at every time of copying operation.

The present invention provides an improved method for producing a stencil, which comprises positioning a stencil sheet having a thin stretched thermoplastic resin film supported on an ink pervious porous substrate in a manner such that the film may be in close contact with the imaged side of the original manuscript and irradiating the thus prepared assembly with a light which is rich in rays having a wavelength ranging from 0.7 to 1.2 microns and has a flash duration from $10^{-4}$ to $10^{-3}$ second to form stencil openings on the thermoplastic film.

For purpose of illustration of the principle, the embodiments of the present invention as well as the improvements accomplished thereby are shown the annexed drawings, in which:

FIG. 1 is an enlarged microscopic photograph with ten magnifications of a mark in lines of 1 mm thick outlined in equilateral octagonal figure having side length of about 2.8 mm which is off-set printed on a fine quality paper (55 kg);

FIGS. 2 (1), (2) and (3) are enlarged microscopic photographs with 10 magnifications of the openings formed by irradiation from a tungsten incandescent lamp, a photographer's flash bulb and an electronic flash discharge tube, respectively;

FIGS. 3 (1), (2) and (3) are enlarged microscopic photographs with ten magnifications of the duplicated copies produced from the corresponding stencils as shown in FIGS. 2 (1), (2) and (3), respectively;

Figure 8:
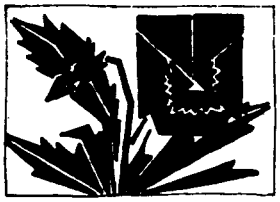
Figure 8:
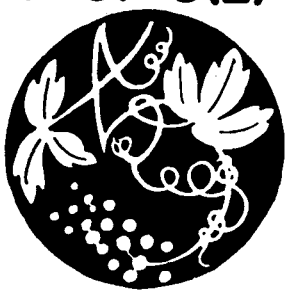
Figure 9:
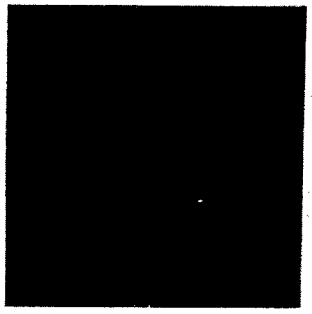
Figure 9:
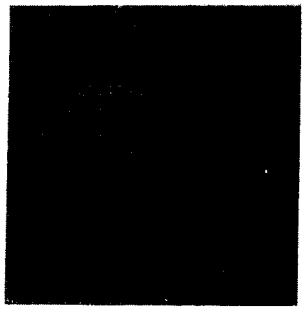
Figure 10:
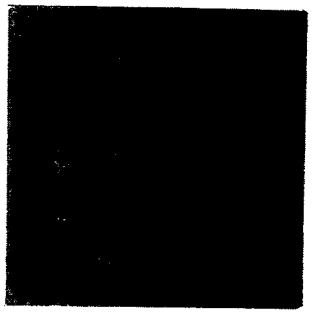
Figure 10:
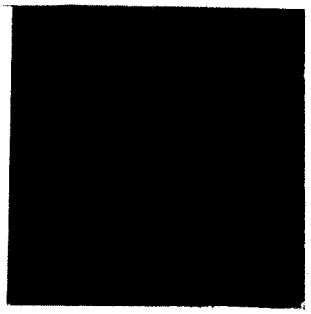

FIGS. 8 (1) and (2) are photographs of the patterns used as the original copies in the Example 2;

FIGS. 9 (1) and (2) are stencil openings produced from the original copy as shown in FIG. 8 (1) by irradiation from a tungsten incandescent lamp and an electronic flash discharge tube, respectively; and FIGS. 10 (1) and (2) are stencil openings produced from the original copy as shown in FIG. 8 (2) by irradiation from a tungsten incandescent lamp and an electronic flash discharge tube, respectively.

In accordance with the present invention, printed surface of an original copy is positioned in close contact with the film of a stencil sheet before flash irradiation is effected. As an original to be used in the present invention, any manuscript prepared by conventional methods such as writing, printing or copying may be used. Since stencil openings are formed by the heat generated in the manuscript image portion, the manuscript is required to contain in the image portion a substance which absorbs the near infra-red rays of light and generates heat. Carbon black is preferred as such a substance.

The stencil sheet to be used in the present invention comprises a thin stretched thermoplastic resin film which is supported on an ink pervious porous substrate. The thermoplastic resin film is desirably stretched to from 2.5 to 10, preferably from 2.5 to 6 times its original dimension in longitudinal and transverse directions in order to accomplish effective stencil openings which are formed by cleavage of the film through instantaneous fusion and shrinkage on heat generation. From a practical standpoint, in view of the energy required for stencil openings, the thermoplastic resin film should preferably have a softening point of 140° C or lower and a thickness from 5 to 12 microns. The materials for the thermoplastic resin films to be used in the present invention may include a polyvinylidene chloride type synthetic resin film, a polypropylene film, a polyvinyl chloride type synthetic resin film, a polyvinyl acetate type synthetic resin film, a polyethylene film etc., which are prepared by inflation molding or biaxial stretching method. Among these, a synthetic resin film of a vinylidene chloride-vinyl chloride copolymer or a polyvinyl chloride synthetic resin film is particularly preferred.

As an ink pervious porous substrate used to support the thermoplastic resin film, such thin papers of natural as well as chemical fibers conventionally used in the prior art as mentioned above may be used. Furthermore, other substrates, which are comparatively heat-resistant and form no barrier for the passage of duplicating ink, may also be used. They may include screens made of filaments of natural or synthetic fibers such as silk, cotton, nylon, polyester, rayon and the like. Screens made of inorganic materials such as metal or glass fiber filaments may also be used.

Figure 1:
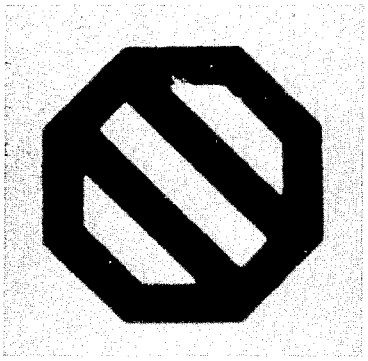
Figure 2:
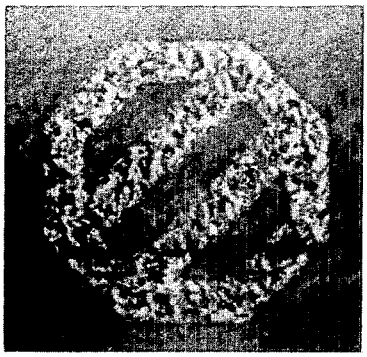
Figure 2:
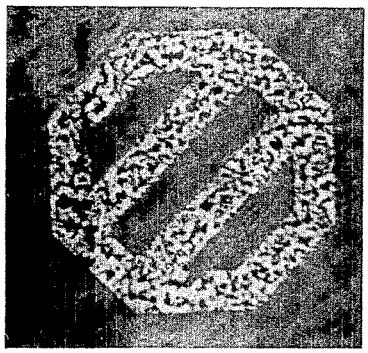
Figure 2:
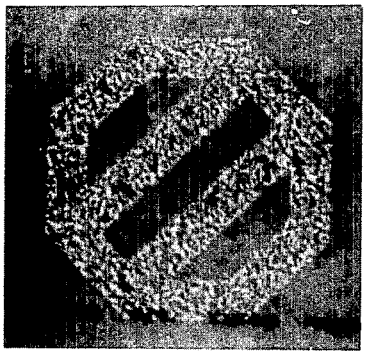
Figure 3:
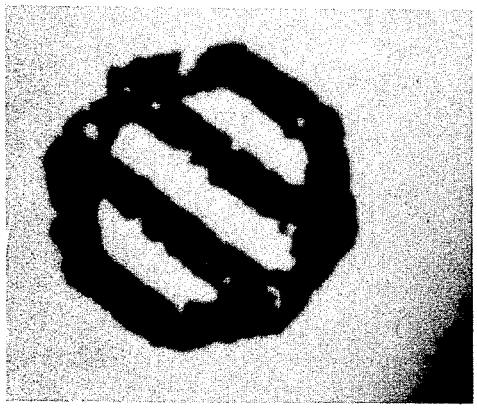
Figure 3:
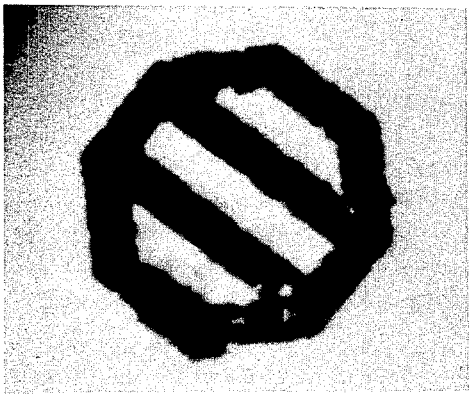
Figure 3:
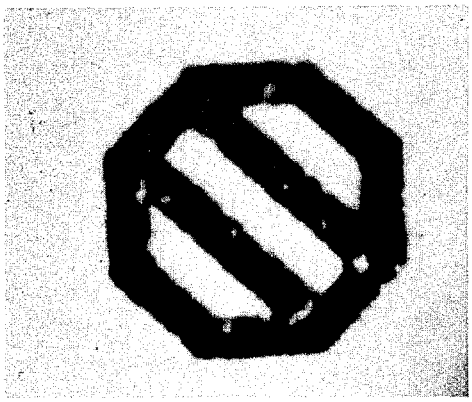

FIGS. 2 (1) and 2 (2) show microscopic photographs of stencils obtained from stencil sheets, each comprising an inflation molded stretched (4×4 times) resin film of vinylidene chloride-vinyl chloride copolymer having a thickness of 7 microns supported on a thin paper made mainly from Manila hemp by using an adhesive of vinyl acetate type in 15% methanol solution. Each stencil sheet is superposed on an original manuscript as shown in FIG. 1. Infra-red radiations were directed upon each assembly by means of a heat-sensitive copying machine embodying a tungsten incandescent lamp (through a 5 mm slit and at a movement speed of 50 mm/sec) and a photographer's flash bulb, respectively. The white portions in the FIGS. 2 (1) and 2 (2) exhibit openings. As clearly seen from these Figures, openings formed by irradiation from a tungsten incandescent lamp or a photographer's flash bulb are comparatively bold. The circumferential border lines around the fused openings are irregular and indistinct. Furthermore, flatness of the sheet is also bad due to the marginal swelling like craters on the surface of the moon, as evidenced by the fact that adjustment of the focus in taking the microscopic photographs is very difficult. It is also observed that the openings are partially swelled out toward areas which are not opened. Thus, no opening corresponding exactly with the original manuscript can be obtained by a prolonged exposure to a tungsten incandescent lamp. Accordingly, copies obtained from these stencils are not also distinct as shown in FIGS. 3 (1) and 3 (2).

Figure 4:
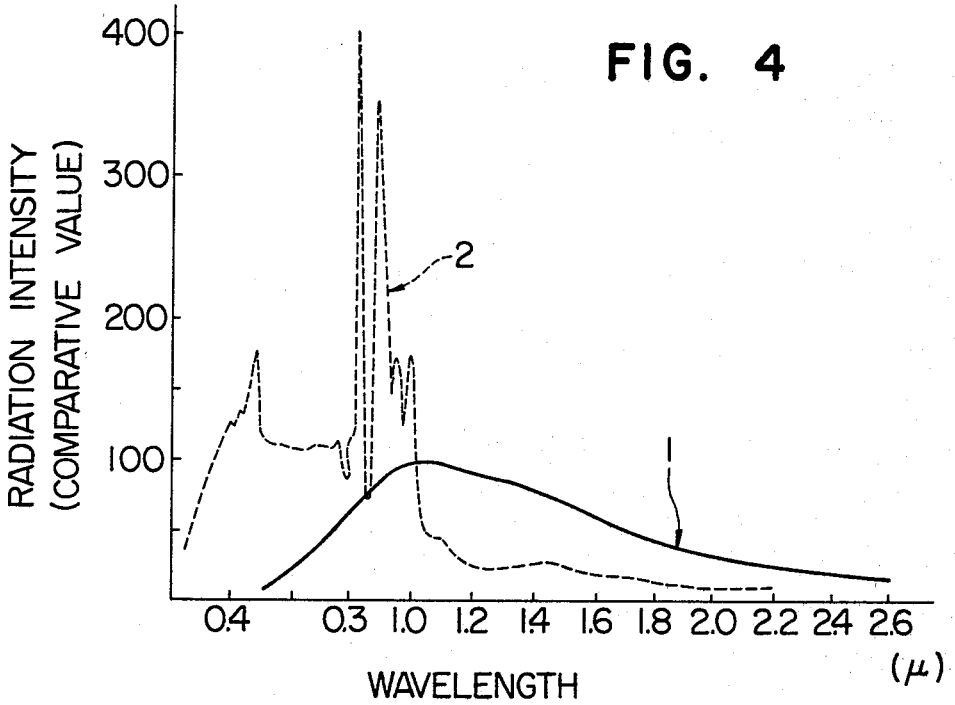
FIG. 4 shows spectral distribution curves of radiations from a conventional tungsten incandescent lamp (line 1) and an electronic flash discharge tube (line 2), respectively.
Figure 5:
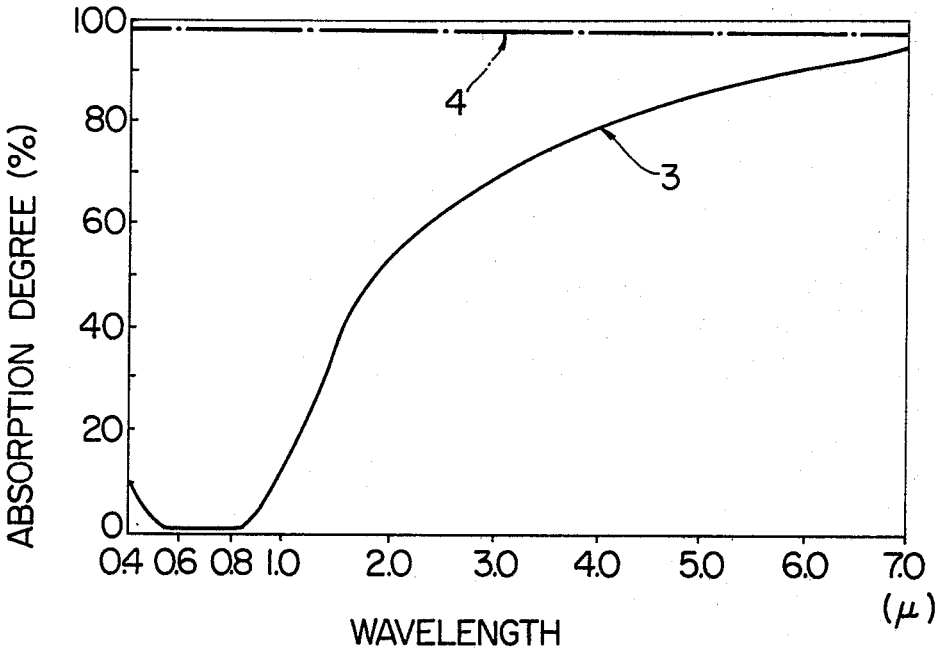
FIG. 5 shows spectral absorption curves of a white paper generally used for an original manuscript (line 3) and of carbon which forms the image portion of the manuscript, respectively.

It has been found that the excessive boldness of the openings from which the prior art heat-sensitive copying method cannot be free is due to a relatively prolonged exposure to radiations having long wavelengths. The line 1 in FIG. 4 is a spectral distribution curve of light from a commercially available tungsten incandescent lamp, while the line 2 that from a xenon-filled electronic flash discharge tube. On the other hand, FIG. 5 shows the spectral absorption curve 3 of a paper generally used as a substrate for an original manuscript and the spectral absorption curve 4 of carbon which forms the imaged areas of the manuscript. From these Figures, it is apparently seen that the spectral distribution curve of light from the tungsten incandescent lamp is gently sloping and contains a considerably large amount of rays having wavelengths more than 1.3 microns which can easily be absorbed by a white paper. Accordingly, as the result of prolonged irradiation of the light having long wavelength, the white paper is radiated sufficiently to generate heat. Such heat unnecessary for stencil opening is accumulated and transmitted to the film to affect deleterious effects on the openings. In order to obtain highly resoluted and distinct openings, it is necessary to avoid generation of such transmission heat. Desirable openings can be obtained by avoiding absorption of infrared rays on such elements as a white background of the original manuscript or a support constituting a stencil sheet as far as possible. For this purpose, it is necessary to use a light, rich in near infrared rays and scarce in rays of wavelengths of 1.3 microns or more, which can discharge a high intensity radiant energy in an extremely short time.

Accordingly, for heat-sensitive stencil opening of the stencil sheet as mentioned above, it has been found suitable to use a light rich in rays having a wavelength ranging from 0.7 to 1.2 microns. By light rich in rays having a wavelength ranging from 0.7 to 1.2 microns, we mean light of which the rays with wavelength of 0.7 microns or more are concentrated at a high percentage in terms of quantity of light (the percentage will hereinafter referred to as $R_{0.7-1.2}$), preferably 50% or more, most preferably 60% or more, within the range of wavelength from 0.7 to 1.2 microns. It is further required that the light should be flashed in a manner such that the intensity of the light may reach its maximum in the minimum amount of time. Thus, a light having a flash duration of from $10^{-4}$ to $10^{-3}$ second is required to be used. The term "flash duration" used here in the specification and the claims is defined as the time span between the two points having one-third peak intensity value on the characteristic time-intensity curve of a flashed light. Furthermore, the light source is desirably of the type which can allow repeated uses.

As the light source which can satisfy the above requirements, electronic flash discharge tubes having a filling of rare gases may generally be used. The rare gases herein used may include helium, argon, neon, Krypton, xenon and the like. An electronic flash discharge tube filled with xenon gas is particularly preferred.

Figure 6:
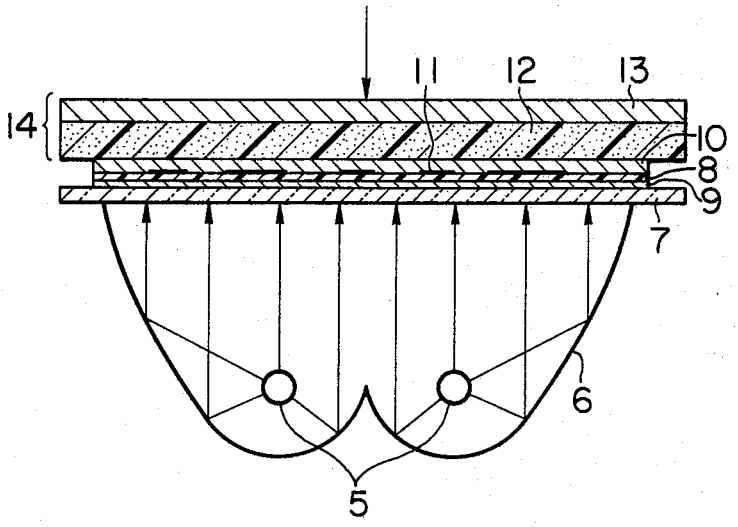
FIG. 6 is a schematic view partially in section showing one embodiment of light irradiation arrangement of the present invention wherein an electronic flash discharge tube is used.
Figure 7:
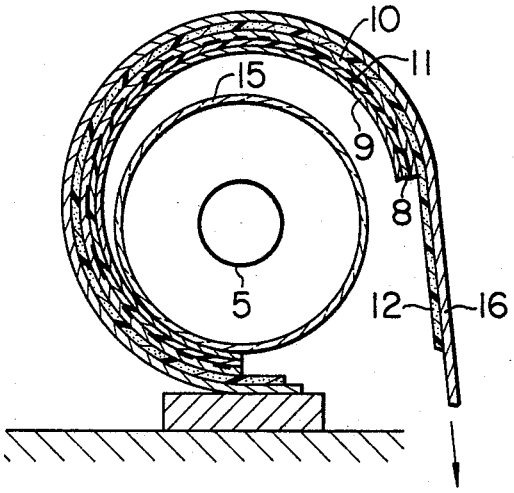
FIG. 7 is a schematic view partially in section showing another embodiment of light irradiation arrangement of the present invention wherein an electronic flash discharge tube is used.

A preferred embodiment of an arrangement for practicing the method of the present invention is shown in FIG. 6 of the accompanying drawings wherein a printing stencil with a size of 220 × 260 mm is prepared. Two electronic flash discharge tubes 5 filled with xenon gas, each having a distance between the electrodes of 250 mm, a tube diameter of 12 mm and a maximum input energy of 700 W · second, are set at the focuses of parabolic reflectors 6 having an opening with a size of 220 × 260 mm. Upon a transparent plate 7 placed on the opening (e.g., soda lime glass plate or acrylic synthetic resin plate) is superposed a stencil sheet comprising the aforesaid synthetic resin film 8 and a porous support 9. A manuscript 10 is positioned in a manner such that the imaged side of the manuscript is contacted with the film surface 8. Upon this assembly is further placed a holding plate 14 comprising a rigid plate 13 such as an aluminum plate layered on an elastic sheet 12 such as a urethane foam. A loading is imposed in the direction of the arrow (pointed at plate 13) to bring the assembly under a firmly pressed state. Then, the charge accumulated in an electrolytic condenser of 3200 microfarads charged at 650 V, which is connected to the above discharge tube, is discharged momentarily for about $10^{-3}$ second to charge the tube wall at about 10,000 volts, whereby the manuscript 10 is irradiated by light with an intensity of photo-energy of 3.0 W · second per unit area ($cm^2$). By the heat generated on absorption of the radiation, openings corresponding exactly with the image portion 11 of the manuscript are formed on the film surface 8.

FIG. 2 (3) shows a microscopic photograph with ten magnifications of the stencil openings which are produced by the method of the present invention as described above by using the same original manuscript as shown in FIG. 1 and the same stencil sheet as used in the preparation of the stencils as shown in FIGS. 2 (1) and 2 (2). The state of opening in FIG. 2 (3) is observed to be different from that of FIGS. 2 (1) and 2 (2); there is no marginal swelling around the opening; and the opening formed is free from excessive boldness. In other words, the circumferential border lines around the opening are very distinct and minute pores are distributed densely throughout the opening to show that the entire opening is extremely distinct. The copies duplicated from this stencil are also excellent in definition as shown in FIG. 3 (3).

EXAMPLE 1

A stencil sheet with a size of 220 × 260 mm, comprising an inflation molded film of 7 microns thick (degree of stretching: 4.0 × 4.0 times) of a vinylidene chloride-vinyl chloride copolymer resin (composition: 85 : 15, wt. %, trade name : Saran) supported on a thin paper made of 100% Manila hemp (10 g/$m^2$) with a vinyl acetate type adhesive (in 10% methanol solution), was positioned on a newspaper. Upon this assembly, flash irradiation was effected for $10^{-3}$ second in a manner as described below to form stencil openings on the aforesaid film. Two electronic flash discharge tubes, filled at a pressure of 100 mm Hg with xenon gas and having a distance between electrodes of 250 mm and a maximum input energy of 700 W · second, were set one at each focus of a parabolic reflector with W-shaped cross section. Each tube was connected to a set of electrolytic condensers (3200 microfarad per each). The condensers charged at 650 V by a suitable rectifying circuit were discharged to charge the tube wall of the above discharge tube to 10000 V, whereupon flash irradiation ($R_{0.7-1.2}$ = 68%) was effected. Copies are produced on fine quality papers from the thus obtained duplicating master by the use of a commercially available stencil printing ink and by means of rotary ink duplicating machine. Distinct copies corresponding exactly with the original manuscript were obtained even after 2000 copies.

On the other hand, a duplicating master prepared by means of a conventional heat-sensitive copying apparatus embodying a tungsten incandescent lamp ($R_{0.7-1.2}$ = 36%) was capable of producing copies which are inferior in definition as compared with those from the duplicating master prepared according to the method of the present invention. The copies from the master of prior art were accompanied with excessive boldness after about 1500 copies.

EXAMPLE 2

An inflation molded, 4.5 times stretched and 10 microns thick film of the same vinylidene chloride-vinyl chloride copolymer as used in Example 1 was supported on a screen made of a commercially available polyester fabric (120 filaments/inch) with an adhesive (Saran Latex; polyvinylidene chloride type latex, 10% conc.) to prepare a sheet for screen printing. The film of this sheet was positioned in close contact with the imaged surface of an original having a picture printed on a sheet of fine quality paper. Then, the sheet was irradiated by the same electronic flash discharge tube as used in Example 1 for $10^{-3}$ second to prepare a stencil.

FIGS. 8 (1) and 8 (2) show photographs of the originals used and FIGS. 9 (1), 9 (2), 10 (1) and 10 (2) those of the stencil duplicates produced therefrom. In FIGS. 9 (2) and 10 (2), are shown photographs of stencil duplicates with a size of 53 × 53 mm from respective originals prepared by the use of the electronic discharge tube, while in FIGS. 9 (1) and 10 (1), those with the same size and from the same originals prepared by the use of a conventional heat-sensitive copying apparatus having a tungsten incandescent lamp therein. In these figures, white color portions correspond to opened areas, and dark color portions to those not opened, respectively. The minute dark spots to be found elsewhere in the opened areas are molten residues of the film sticking on the screen. The stencil opening by means of the heat-sensitive copying apparatus having a tungsten incandescent lamp therein was conducted under the conditions most suitable for stencil printing. It was observed that the stencil duplicate prepared by the electronic flash discharge tube was by far less in amount of the molten residues of the film remaining in the opened areas on the screen and more excellent in definition of the whole opened image than that prepared by the heat-sensitive copying apparatus having a tungsten incandescent lamp therein. When stenciling was conducted on fine quality papers with screen printing ink by using the stencil prepared by means of the electronic flash discharge tube, copied image was as distinct as ever even after 2500 copies. On the other hand, when stenciling was conducted under the same conditions as mentioned above by using the stencil prepared by tungsten incandescent lamp irradiation, copied image became indistinct after about 1500 copies, owing to the sediments of ink accumulated around the molten film residua.

EXAMPLE 3

As shown in FIG. 6, an electronic flash discharge tube 5 of the same type as described in Example 1 having a distance between electrodes of 250 mm, a tube diameter of 12 mm and a maximum input energy of 700 W · second was used as light source, and assembled in the center of a pyrex glass cylinder 15, having a thickness of 2 mm and an external diameter of 30 mm. A stretched (5.0 × 5.0 times) polyvinylidene chloride film 8 prepared by the inflation molding method, having a thickness of 12 microns, was supported on a porous support 9 of the same thin paper of Manila hemp as used in Example 1 with a vinyl acetate type adhesive (in 10% methanol solution). This sheet was wound around the wall of the above cylinder 15 in a manner such that the support of the sheet may be in close contact therewith. Upon the thus positioned sheet was superposed an original manuscript 10 in a manner such that the image portion 11 thereof may be contacted with the film surface 8, and further thereupon are placed holding sheets comprising layers of a urethane foam sheet 12 and a polytetrafluoroethylene (Teflon: trade name) sheet 16 which is fixed at one terminal end. While tension is imposed in the direction of the arrow so that the layers of the sheet for stencil and the original manuscript may come in close contact with the glass cylinder 15, flash irradiation was conducted by the electronic flash discharge tube for about $10^{-3}$ second to prepare a stencil. When stenciling was conducted on fine quality papers by using a commercially available printing ink and a rotary ink duplicating machine, about 2000 distinct copies corresponding exactly with the original manuscript were produced.

For comparison, a stencil was produced from the same stencil sheet as described above by means of a conventional heat-sensitive duplicating apparatus embodying a tungsten incandescent lamp. The stencil openings were not distinct due to excessive boldness and marginal swelling therearound. Accordingly, copies produced from this stencil on fine quality papers were poor in distinctness. In addition, copies obtained after about 1500 copies were suddenly degraded in resolution and disfigurement of letters was prominent in these copies.

EXAMPLE 4

A biaxially stretched (3.0 × 3.0 times) polypropylene film with a thickness of 10 microns was supported on the same thin paper of Manila hemp and with the same adhesive as used in Example 1 to prepare a stencil sheet with a size of 220 × 260 mm. This stencil sheet was positioned on an original copy of English 6-point types copied by means of a dry electrostatic copying machine. Then, similarly as in Example 1 flash irradiation was effected upon the assembly to form stencil openings. By the use of the stencil thus prepared, copies were produced similarly as in Example 1, with the result that copies obtained after about 2000 copies were very distinct and corresponded exactly with the original copy.

Example 4 was repeated, but a photographer's flash bulb with total quantity of light of 60000 lumen · second was used as the light source in place of the electronic flash discharge tube. The stencil openings were observed to be free from such excessive boldness or swelling therearound, as found in the stencil openings formed by irradiation from a tungsten incandescent lamp. But, as compared with the stencil openings obtained in Example 4, they contained a larger amount of marginal swelling and were inferior in definition. Accordingly, when about 2000 copies are produced from this stencil, they were inferior in distinctness of the copied images.

EXAMPLE 5

An unstretched polypropylene film with thickness of 10 microns (degree of stretching: less than twice) was supported on the same thin paper of Manila hemp and with the same adhesive as used in Example 1 to prepare a stencil sheet with a size of 220 × 260 mm. This stencil sheet was superposed on an original typewritten manuscript. Then, flash irradiation was effected similarly as described in Example 1 by means of an electronic flash discharge tube to prepare a stencil (Sample A).

Likewise, a stencil was also produced by the use of the same stencil sheet comprising a stretched polypropylene film as used in Example 4 (Sample B).

The stencil openings of Sample B were extremely distinct, corresponding exactly with the original manuscript, whereas, in Sample 3 comprising unstretched film, no image corresponding with the original manuscript was obtained since no burst opening through heat shrinkage is accompanied when the unstretched film is melted by the heat generated at the image portions.

We claim:

1. Method for producing a printing stencil comprising
   (a) positioning a stencil sheet which includes a thin stretched thermoplastic resin film supported on an ink pervious porous substrate, on an original with an imaged side of said original in close contact with said resin film, said original image comprising a substance which absorbs light of a wavelength in the near infra-red range of and above 0.7 micron and which releases heat of absorption at said wavelengths, and
   (b) irradiating the resulting assembly formed in (a) with high intensity light having a high radiation intensity for wavelengths of 0.7 micron or more concentrated at 60% or more in terms of quantity of light within the wavelength range of from 0.7 to 1.2 microns, said radiation being effected for a time interval only of from about $10^{-4}$ to about $10^{-3}$ second, said radiation being absorbed by said original image to generate absorptive heat thereat, and (c) producing openings by said absorptive heat in corresponding portions of said resin film which are opposed to said original image.

2. A method according to claim 1, wherein the irradiation is by means of a xenon-filled discharge tube.

3. A method according to claim 1, wherein said assembly is irradiated through said resin film.

4. Method of claim 1, wherein the thin stretched thermoplastic film is selected from a polyvinylidene chloride type synthetic resin film, polyvinyl chloride type synthetic resin film, a polypropylene film, a polyethylene film, and a polyvinyl acetate type synthetic resin film, which are prepared by inflation molding or biaxial stretching method.

5. The method of claim 1, wherein the stretched thermoplastic film is one which has been previously stretched to 2.5 to 6 times its original dimension in longitudinal and transverse directions.

6. The method of claim 1, wherein the thin stretched thermoplastic film has a thickness of from 5 to 12 microns.

7. The method of claim 1, wherein the irradiation is by means of a xenon-filled discharge tube having a spectral distribution curve corresponding to line 2 of FIG. 4.

8. The method of claim 7, wherein the resulting assembly is so irradiated in (b) with an intensity of about 3 Watt-sec. per $cm^2$ for about $10^{-3}$ sec.

* * * * *